United States Patent [19]

Tachmindji et al.

[11] 4,188,906

[45] Feb. 19, 1980

[54] SUPERCAVITATING PROPELLER WITH AIR VENTILATION

[76] Inventors: Alexander J. Tachmindji, 4000 Cathedral Ave. N.W.; Marlin L. Miller, 4404 Albemarle St. N.W., both of Washington, D.C. 20016; William B. Morgan, 410 Anderson Ave., Rockville, Md. 20850

[21] Appl. No.: 836,039

[22] Filed: Aug. 25, 1959

[51] Int. Cl.[2] ..... B63H 1/18

[52] U.S. Cl. ..... 115/34 R; 416/90 A

[58] Field of Search ..... 115/34; 170/172, 135.4, 170/159

[56] References Cited

U.S. PATENT DOCUMENTS

| | | | |
|---|---|---|---|
| 230,566 | 7/1880 | Olmsted | 416/90 A |
| 257,416 | 5/1882 | Uren | 416/90 A |
| 1,097,991 | 5/1914 | Sawyer | 115/34 |
| 1,119,178 | 12/1914 | Krantz | 115/34 |
| 1,190,755 | 7/1916 | Hahn | 416/90 A |
| 2,058,361 | 10/1936 | Sherwood | 416/92 |
| 2,149,951 | 3/1939 | Baker | 416/91 |
| 2,689,541 | 9/1954 | Williams | 416/90 R |

FOREIGN PATENT DOCUMENTS

| | | | |
|---|---|---|---|
| 817236 | 5/1937 | France | 416/91 |

*Primary Examiner*—Verlin R. Pendegrass

*Attorney, Agent, or Firm*—R. S. Sciascia; Q. E. Hodges

EXEMPLARY CLAIM

1. A method of decreasing the deleterious effects of cavitation on a ship propeller comprising providing a propeller having supercavitating blade sections, rotating said propeller to drive said ship, and ejecting air from the suction side of each said blade when said ship speed and propeller speed reach a predetermined point to thereby produce a cavity which extends from the leading edge to a point in the water beyond the trailing edge of said blade and envelops the entire suction side of said blade.

6 Claims, 5 Drawing Figures

SUPERCAVITATING PROPELLER WITH AIR VENTILATION

The invention described herein may be manufactured and used by or for the Government of the United States of America for governmental purposes without the payment of any royalties thereon or therefor.

The present invention relates to a supercavitating propeller with air ventilation and, more particularly, to a supercavitating propeller with air ventilation wherein the air is injected into the cavities formed on the suction side of each of the propeller blades.

The increasing speeds of naval vessels and underwater missiles have introduced a number of problems in the design of propellers and are imposing stringent limitations upon the configuration of the propulsion mechanism. Of these difficulties the most important one is propeller cavitation and its associated effects on performance, noise, and erosion.

Cavitation results from a local reduction in pressure to a point less than or equal to the vapor pressure of water. Any object when moved at sufficient speed through water will cause cavities within the water. Each cavity contains a swirling mass of droplets and vapor which collapses suddenly when the surrounding pressure becomes high enough. As the cavity collapses, water rushes to fill the void, momentarily raising the pressure to a very high value at the point where the inrushing liquid comes together. If the point of collapse happens to be in contact with an object in the water, the object receives a blow and its surface is stressed locally beyond the elastic limit.

If the object in the water happens to be a conventional ship's propeller blade surface, cavitation is produced, resulting in erosion of the propeller blades, noise caused by collapse of cavities against the blade surface, and a reduction in the thrust and torque coefficients accompanied by a reduction in efficiency.

A number of devices such as pump jets and shrouded propellers have been tried with the purpose of delaying the inception of cavitation. It is apparent, however, that for vehicles operating at very high speeds (50 knots and above) suppression of cavitation is impossible.

While the problems of erosion and lowered efficiency could be compensated for to some extent in high speed naval vessels by replacing propellers frequently and increasing available power, the cavitation noise would always be subject to detection by an enemy. A system of noise screening was tried wherein a plurality of air vents were provided at the leading edge of a hollow conventionally shaped propeller and air was forced through the vents causing small air bubbles behind the propeller which would absorb to some degree the cavitation noise in the back of the propeller. However, noise was transmitted undiminished in all directions forward of the propeller plane.

The present invention is a propeller which is designed to operate with fully developed cavitations, but avoids the deleterious effects enumerated above. The blade section is chosen to give maximum cavitation even at relatively low speeds and the suction side of the blade has a vent or vents through which air is introduced to the cavity. By the present invention an air filled cavity is produced at the leading edge of each blade and extends to a point beyond the trailing edge so that the back of each blade is completely enveloped and the cavity collapses to the rear of the propeller. Since the cavity does not collapse anywhere at the blade surface, the effect of collapse is not felt by the blade. Erosion of the blade is minimized, the noise signature is greatly reduced, and efficiency is maintained.

It is thus an object of this invention to provide an efficient propeller for high speed as well as relatively low speed operation.

A further object is the provision of a system for reducing the deleterious effects of propeller cavitation without sacrificing speed.

Other objects and many of the attendant advantages of this invention will be readily appreciated as the same becomes better understood by reference to the following detailed description when considered in connection with the accompanying drawings wherein.

Figure 1:
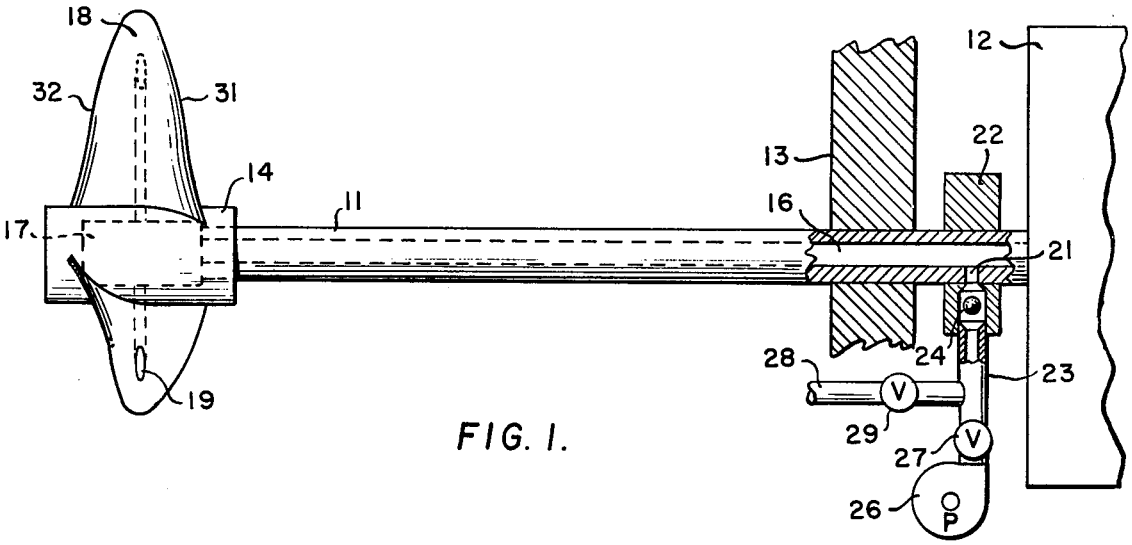
FIG. 1 is a side elevational view, partly in section, of a preferred embodiment of the invention.

Referring now to the drrawings, wherein like reference characters designate like or corresponding parts throughout the several views, there is shown in FIG. 1 (which illustrates a preferred embodiment) a propeller shaft 11 running from a power source 12 through a bearing 13 in a ship's hull and having a drive propeller 14 journaled on the outer end thereof.

Propeller shaft 11 has an axial bore 16 open at the propeller end to a hollow 17 in the center of the hub of propeller 14. A series of holes 19 in the respective suction faces of propeller blades 18 connect with the hollow 17 of the propeller hub.

Inside the ship's hull a hole or holes 21 drilled radially in shaft 11 are open inside a packed bearing 22 to an air line 23. Included in air line 23 is a non-return check valve 24. Air line 23 is fed either from a pump 26, which provides a predetermined pressure by opening pump valve 27, or alternatively from aperture 28, which is open to atmospheric pressure, by opening valve 29.

Figure 2:
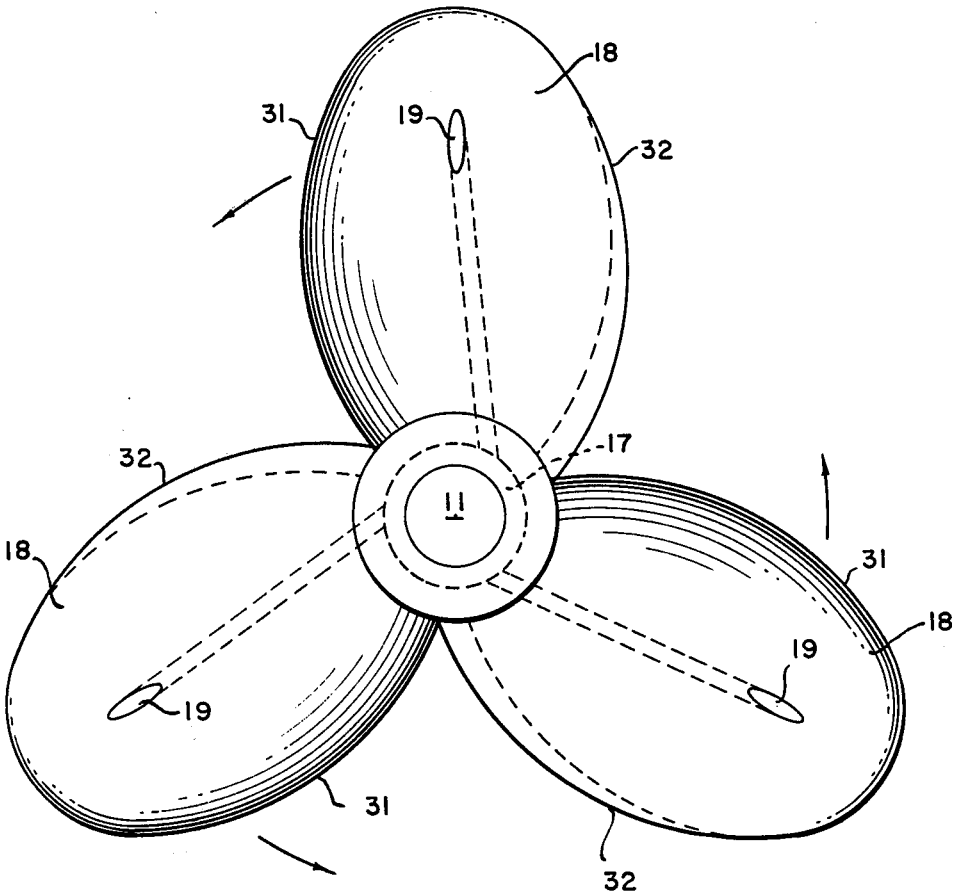
FIG. 2 is a front view of the propeller of the embodiment shown in FIG. 1.
Figure 3:
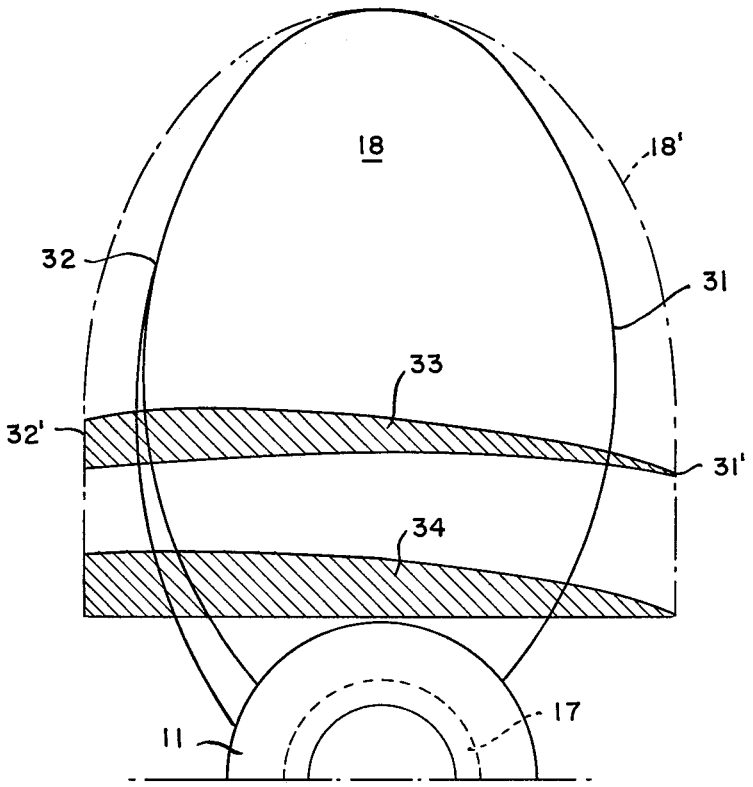
FIG. 3 is a rear view of the propeller of FIG. 1 showing particular details of blade shape including representative sections.
Figure 4:
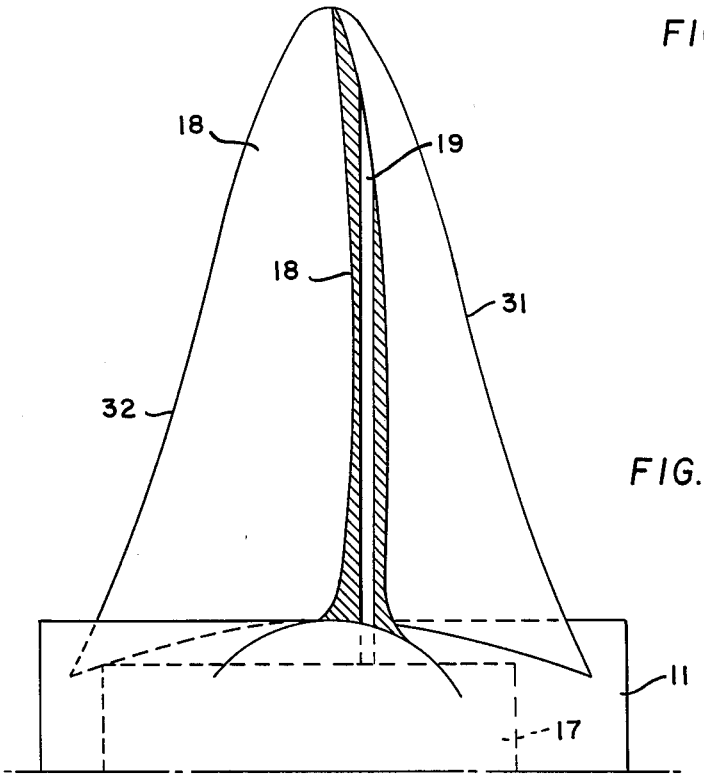
FIG. 4 is a fragmentary side view of the propeller shown in FIG. 1 including details of a representative blade cross section.

From FIGS. 2, 3, and 4 it will be seen that leading edge 31 of each blade 18 is extremely thin while trailing edge 32 of each blade is considerable thicker, and, as shown in this embodiment, may be flat near the hub without causing any ill effects. As can be seen from the cross section shown in FIG. 4, the base of each blade is considerably thicker than the edge and the pressure face may have a radial camber.

FIG. 3 shows at 18' an expanded outline of the blade. It will be realized by those skilled in the art as well as obvious from the drawings that the blade is twisted to a given pitch to cause the propeller to drive the ship through the water. Expanded outline 18' is the outline of a blade which has been flattened to show its actual extent rather than a projection as seen at 18 in each of the drawings. Hatched portions 33 and 34 show the shape of representative cross sections of the flattened blade, that is, a blade having a pitch equal to zero.

It should be noted that cross section 33 is a supercavitating section. A supercavitating section may be defined as a hydrofoil or propeller blade section having an outline which will produce at sufficient speed and proper angle of attack a cavity originating at the leading edge and extending beyond the trailing edge which completely encloses the suction side of the section and operates efficiently under such conditions. Water coming in contact with the leading edge 31' (which corresponds to edge 31 in the projected outline of the twisted blade) will at very low speeds flow smoothly over both surfaces of the blade, but the shape of the section is such that at a small angle of attack and slightly greater speed the pressure from the leading edge 31' to beyond the trailing edge 32' on the back of the blade will be reduced to the vapor pressure of water and a cavity encompassing the entire back of the blade will result.

A supercavitating section is derived from the theory that an infinitely thin hydrofoil having a slight camber and a given small angle of attack moving through water at a given speed great enough to cause cavitation will produce a cavity on the suction side of the hydrofoil which is infinitely thin at the leading edge and increasing in thickness to a point beyond the trailing edge where the pressure again becomes too great to sustain the cavity. It has been found that material may be added to the suction side of the hydrofoil at all points which would be inside the cavitation bubbles, for purposes of added strength, without any deleterious effects to the cavity formation.

It will be apparent, however, that a propeller utilizing such sections would need either a very small pitch or a great speed or a combination of small pitch and high speed to sustain cavities over the entire back of the propeller blades. Obviously, a low pitch contributes to low efficiency and a ship cannot be operated at high speeds all of the time.

Figure 5:
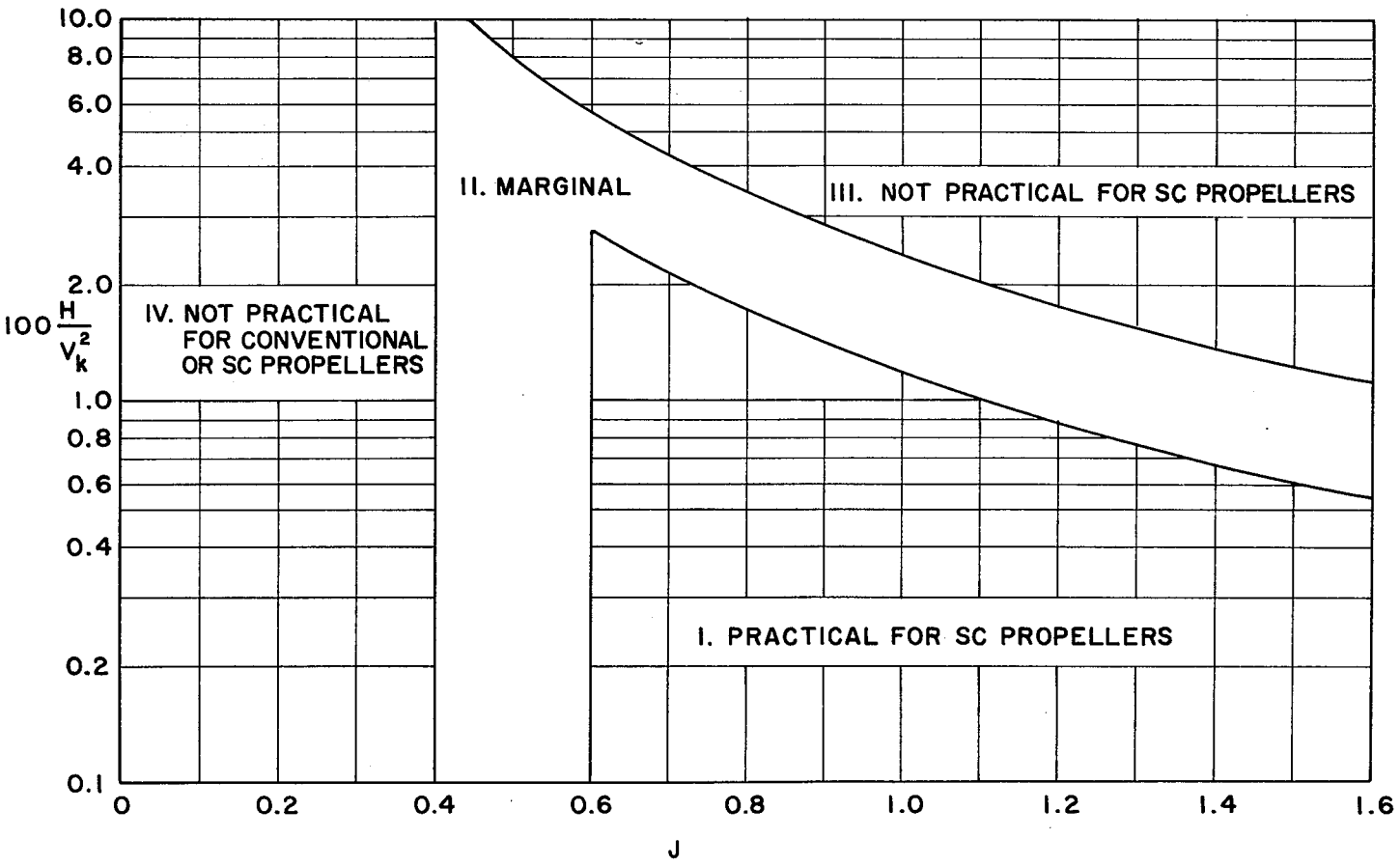
FIG. 5 is a plot demonstrating the ranges of practicality for supercavitating propellers as well as conventional propellers.

The plot shown in FIG. 5 illustrates the results of performance tests with various types of propellers. The cavitation number ($\sigma$) of an object moving through water is defined as:

$$\sigma = 2gH/V_a^2$$

where g is the acceleration due to gravity (a constant), H is the absolute free stream pressure at the centerline of the object minus the cavity pressure in feet of water, and $V_a$ is the speed of advance of the object through the water.

For purposes of illustration, the quantity $100H/V_k^2$, wherein $V_k$ is the speed of advance in knots, is plotted since it is proportional to the cavitation number and is more convenient. Plotted as the abscissa is the speed coefficient J defined as:

$$J = V_a/nD.$$

where $V_a$ is speed of advance, n is revolutions per unit time of the propeller and D is propeller diameter.

FIG. 5 shows in section 1 the range which is practical for propellers having blades of supercavitating section. As will be realized by one skilled in the art, operation in this range requires, in general, a high speed of advance which would result in cavitation for conventional propellers and the resultant deleterious effects caused by partial cavitation.

Area III shows the conditions under which conventional propellers are practical but supercavitating propellers are not. This range requires, in general, a slower speed of advance. At these speeds incomplete cavitation would occur with supercavitating sections resulting in much the same effect as with conventional propellers at high speed.

Area II shows the range in which marginal performance can be obtained with either supercavitating or conventional propellers, while Area IV shows the range which is not practical for any propeller because of poor efficiency. This range generally is the very low speed range.

It has been found in tests that a cavitation number ($\sigma$) at seventenths of the propeller radius must be less than 0.045 to insure fully developed cavitation on the back of a supercavitating propeller blade and to avoid the ill effects inherent with cavitation which collapses at the blade surface.

This invention makes use of the characteristics of the practical range for supercavitating propellers by decreasing the value of pressure head H, thus decreasing the cavitation number and thereby decreasing the speed of advance necessary for efficient operation with a supercavitating propeller blade section. The value of H for a propeller is equal to the pressure at the centerline of the propeller shaft minus the cavity pressure inside the bubble which is normally equal to the vapor pressure of water. It was found that an increase of pressure inside the bubble would in effect be the same as increasing the vapor pressure of the water and therefore H and the cavitation number ($\sigma$) would be decreased.

The present invention maintains cavitation at speeds which would normally be outside of the range of practicality for supercavitating propellers by injecting air at a predetermined pressure into the cavity formed by normal cavitation as described below.

Referring again to FIG. 1, as propeller 14 is rotated by power source 12 acting through shaft 11, the ship will begin moving slowly. Check valve 24 (which is shown ony diagrammatically) is arranged to close the air path at low speeds to prevent water from coming into the ship through the air lines. At low speeds the propeller acts like a conventional propeller in that no cavities are formed. However, as the ship builds up speed, the supercavitating sections reach the point at which partial cavitation occurs. At this point check valve 24 opens automatically due to suction behind the propeller blade. If valve 29 is open, air travels due to suction from opening 28, or alternatively if valve 27 is open air travels from pump 26; through line 23, axial bore 16 in propeller shaft 11, hollow 17 of the propeller hub and out of holes 19 in the propeller blades 18. Holes 19 are placed according to propeller shape so that air injected from the holes enters the cavitation bubble even though the cavity is small. The air causes the bubble to expand resulting in complete cavitation over the suction side of the blade to a point beyond the trailing edge.

It will be realized that although the embodiment of the invention described herein has three blades, the number of blades as well as the pitch of the propeller and number of air holes in each blade may be changed in accordance with specific design requirements. The design of the supercavitating section and hole placement will vary somewhat with change of pitch and number of blades.

Thus, there has been described a propeller system which is efficient at high speeds as well as relatively low speeds, while materially reducing the erosion effects of cavitation on propeller blades and reducing substantially the propeller noise of ships, thus lessening the possibility of detection.

Obviously many modifications and variations of the present invention are possible in the light of the above teachings. It is therefore to be understood that within the scope of the appended claims the invention may be practiced otherwise than as specifically described.

What is claimed is:

1. A method of decreasing the deleterious effects of cavitation on a ship propeller comprising providing a propeller having supercavitating blade sections, rotating said propeller to drive said ship, and ejecting air from the suction side of each said blade when said ship speed and propeller speed reach a predetermined point to thereby produce a cavity which extends from the leading edge to a point in the water beyond the trailing edge of said blade and envelops the entire suction side of said blade.

2. A method of ship noise reduction comprising providing said ship with a propeller having supercavitating blade sections, rotating said propeller to drive said ship thereby forming cavities in the water behind the blades of said propeller when said propeller reaches a predetermined speed, and injecting air into said cavities when said predetermined speed is reached; said air being at sufficient pressure to cause said cavities to envelop the suction side of each said blade.

3. A system for reducing the effects of cavitation on ship propellers comprising a propeller having supercavitating blade sections, means for rotating said propeller to drive said ship at sufficient speed to develop cavitation at the suction side of the leading edges of each propeller blade, and means for limiting the cavitation number at seventenths of the propeller radius to 0.045 upon reaching the speed necessary for the inception of cavitation.

4. The invention as defined in claim 3 wherein said means for limiting the cavitation number includes means for ejecting air from the suction side of each propeller blade.

5. In a high speed sea going ship having a hull and a drive power source within said hull, the improvement comprising a hollow propeller shaft connected to said power source and passing through said hull, a propeller having a plurality of blades and a hollow hub connected to said drive shaft, each of said blades having a supercavitating cross-section and having a pressure side, a suction side, and a hole passing from the suction side of each blade to the hollow in said hub; and means active upon the inception of cavitation for causing air to flow from the interior of said ship through said hollow shaft, hollow hub, and said holes in said blades whereby a cavity produced at the leading edge of each blade is made to extend over the entire suction side of each blade.

6. A ship propulsion system comprising a power source, a propeller having a plurality of blades and a hub, a propeller shaft extending from said hub to said power source, each said propeller blade having a pressure side and a suction side, said pressure side of each propeller blade having a cross camber; an air passage from said suction side of each said blade through said hub and said shaft, and means for opening said air passage to a source of air pressure within said ship when said power source drives said propeller at a predetermined speed, said means including means for blocking said air passage when said propeller moves at less than said predetermined speed.

* * * * *